US010488025B2

(12) United States Patent
Lin

(10) Patent No.: US 10,488,025 B2
(45) Date of Patent: Nov. 26, 2019

(54) INTERRUPTION-FREE TRACK LIGHT

(71) Applicant: Ting-Mao Lin, Taoyuan (TW)

(72) Inventor: Ting-Mao Lin, Taoyuan (TW)

( * ) Notice: Subject to any disclaimer, the term of this patent is extended or adjusted under 35 U.S.C. 154(b) by 0 days.

(21) Appl. No.: 16/269,970

(22) Filed: Feb. 7, 2019

(65) Prior Publication Data

US 2019/0316765 A1 Oct. 17, 2019

(30) Foreign Application Priority Data

Apr. 12, 2018 (TW) ..... 107204737 U

(51) Int. Cl.
*F21V 21/35* (2006.01)
*F21Y 103/00* (2016.01)

(52) U.S. Cl.
CPC ..... *F21V 21/35* (2013.01); *F21Y 2103/00* (2013.01)

(58) Field of Classification Search
CPC ..... F21V 21/35; F21Y 2103/00
See application file for complete search history.

(56) References Cited

U.S. PATENT DOCUMENTS

2008/0212323 A1* 9/2008 Chien ..... H04N 5/2354 362/249.07
2014/0218906 A1* 8/2014 Liu ..... F21V 21/30 362/220
2015/0159840 A1* 6/2015 Liu ..... F21V 21/35 362/648
2015/0354765 A1* 12/2015 Hannawa ..... F21V 33/0044 362/92
2018/0118097 A1* 5/2018 Thompson ..... F21S 4/28

* cited by examiner

*Primary Examiner* — Donald L Raleigh

(57) ABSTRACT

An interruption-free track light includes a track including a hollow track shell with a moving space defined therein, a plurality of power supply components longitudinally arranged in the hollow track shell at two opposite lateral sides and a mating connection rail longitudinally mounted at a bottom side of the hollow track shell, and a lighting fixture including a light-emitting body slidably coupled to the mating connection rail, an electrical connector, a plurality of clamps provided at the top side of the light-emitting body and inserted into the hollow track shell and abutted against an inner edge of the mating connection rail to hold the electrical connector in the moving space in conduction with the power supply components and two end caps made of a light guide material and respectively fastened to two opposite ends of the light-emitting body.

5 Claims, 10 Drawing Sheets

INTERRUPTION-FREE TRACK LIGHT

BACKGROUND OF THE INVENTION

1. Field of the Invention

The present invention relates to track light technology and more particularly, to an interruption-free track light, which avoids generation of invalid dark area and achieves the effects of interruption-free illumination, ease of installation and enhanced brightness.

2. Description of the Related Art

The traditional lighting fixture is fixedly installed on the ceiling or wall surface to provide a fixed light exit area. If a long bright illumination area needs to be produced in a certain area, multiple lighting fixtures are connected in a string by using electrical wires or sockets, and then the connected string of lighting fixtures are mounted to the ceiling or wall surface. However, this mounting procedure is complicated and inconvenient. Further, the arrangement of the electrical wires or sockets and the opaque end caps of each lighting fixture can cause generation of an invalid dark area between each two adjacent lighting fixtures, resulting in uneven brightness and reduced illumination.

SUMMARY OF THE INVENTION

The present invention has been accomplished under the circumstances in view. It is therefore the main object of the present invention to provide an interruption-free track light, which provides a light guide end cap at each of two opposite ends of the light-emitting body of each lighting fixture to eliminate the generation of an invalid dark area when multiple lighting fixtures are mounted in the track and arranged in a line, achieving the effects of interruption-free illumination and enhanced brightness.

It is another object of the present invention to provide an interruption-free track light, which allows the electrical connector and clamps of the lighting fixture to be directly positioned in the track by plugging to keep the electrical connection in conduction with the power supply components in the track, facilitating installation.

To achieve these and other objects of the present invention, an interruption-free track light comprises a track and at least one lighting fixture mounted in the track. The track comprises a hollow track shell, a plurality of power supply components and a mating connection rail. The hollow track shell defines therein a moving space. The power supply components are longitudinally arranged in the hollow track shell at two opposite lateral sides. The mating connection rail is longitudinally mounted at a bottom side of the hollow track shell. Each lighting fixture comprises a light-emitting body, a plurality of clamps, an electrical connector and two end caps. The clamps and the electrical connector are provided at the top side of the light-emitting body. The electrical connector is electrically connected to an internal circuitry of the light-emitting body. The two end caps are made of a light guide material and respectively fastened to two opposite ends of the light-emitting body. The clamps are inserted into the hollow track shell of the track and abutted against an inner edge of the mating connection rail to hold the electrical connector in the moving space of the hollow track shell in conduction with the power supply components.

Other advantages and features of the present invention will be fully understood by reference to the following specification in conjunction with the accompanying drawings.

DETAILED DESCRIPTION OF THE PREFERRED EMBODIMENT

Figure 1:
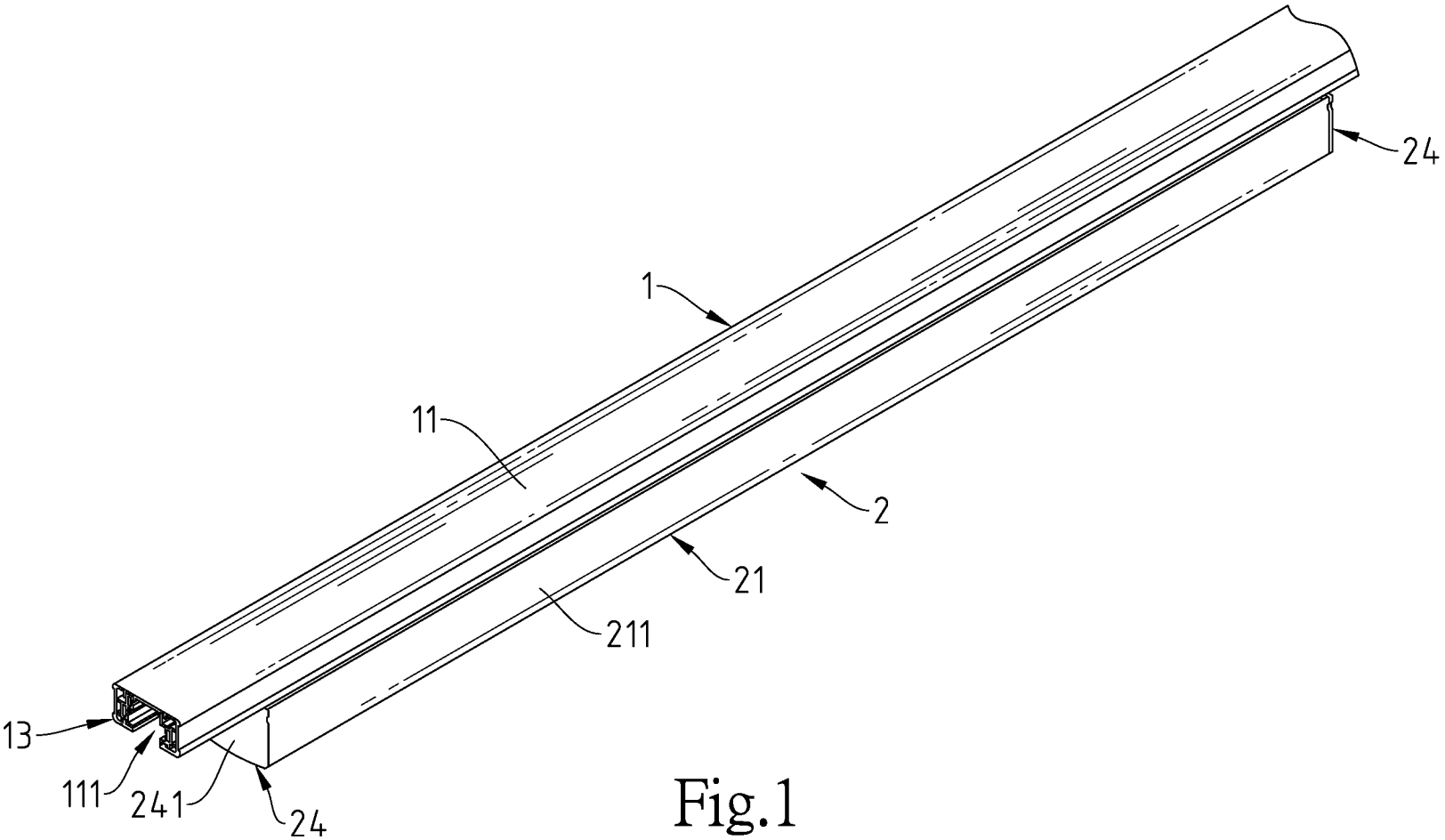
FIG. 1 is an oblique top elevational view of an interruption-free track light in accordance with the present invention.
Figure 2:
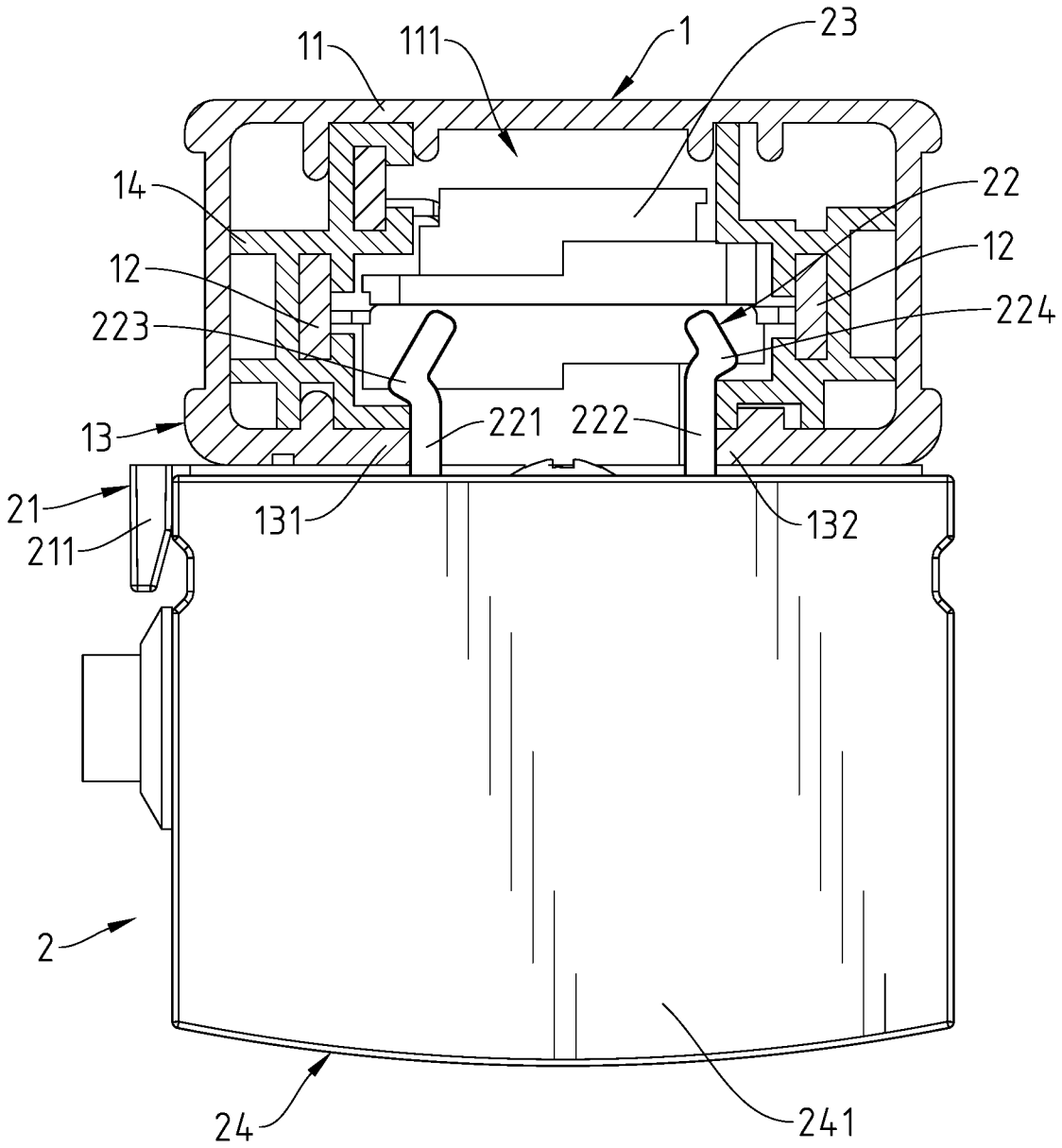
FIG. 2 is an end view of the interruption-free track light in accordance with the present invention.
Figure 3:
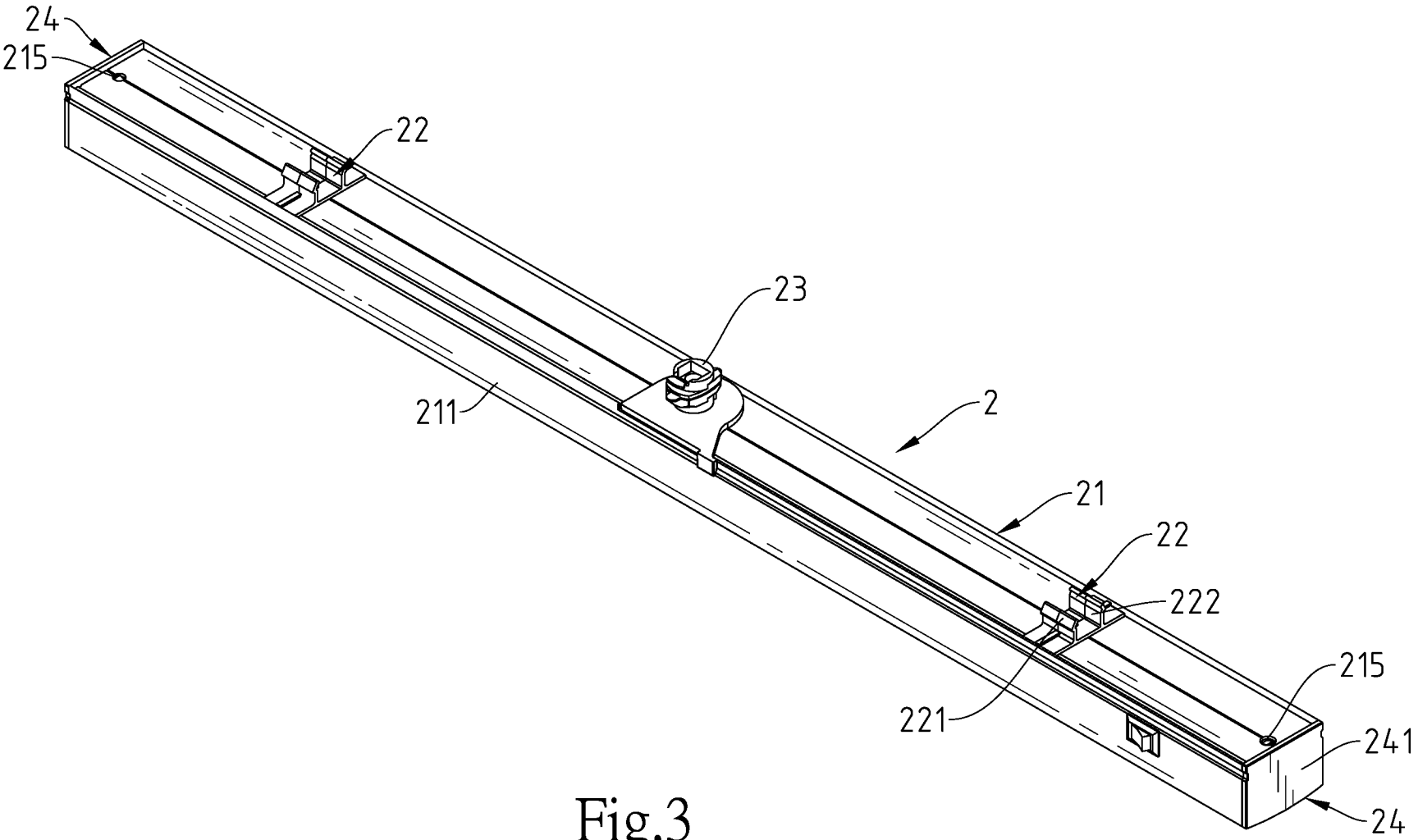
FIG. 3 is an oblique elevational view of the lighting fixture.
Figure 4:
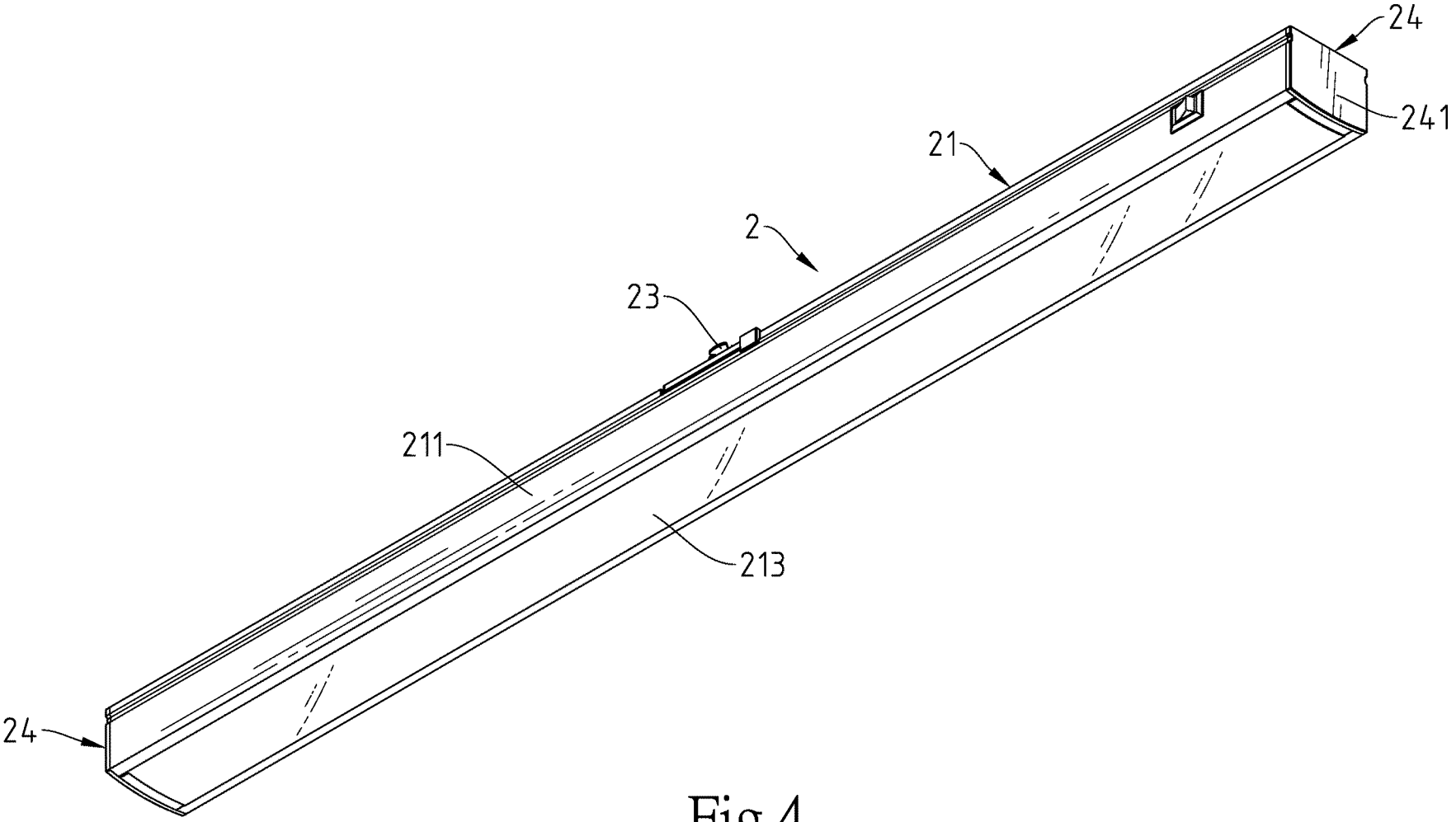
FIG. 4 corresponds to FIG. 3 when viewed from another angle.
Figure 5:
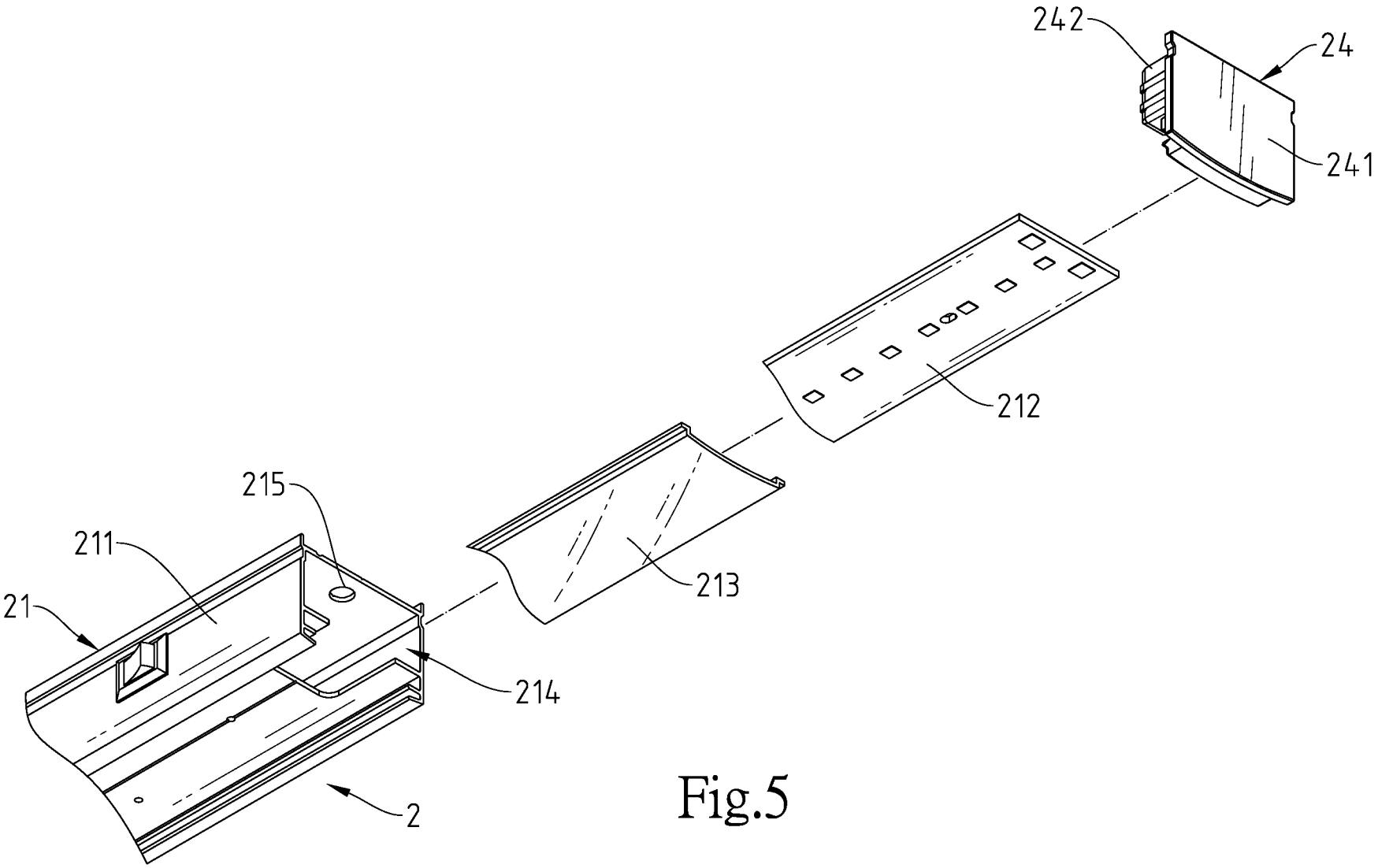
FIG. 5 is an exploded view of the lighting fixture.
Figure 6:
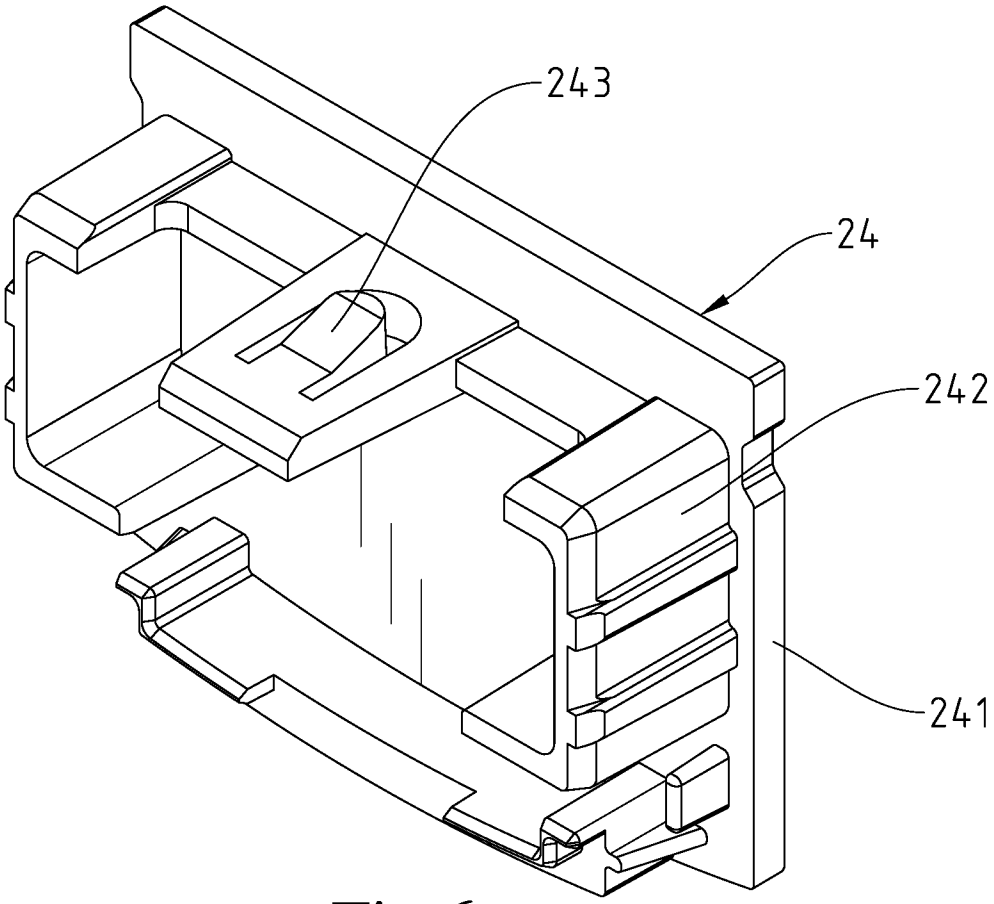
FIG. 6 is an elevational view of the end cap.
Figure 7:
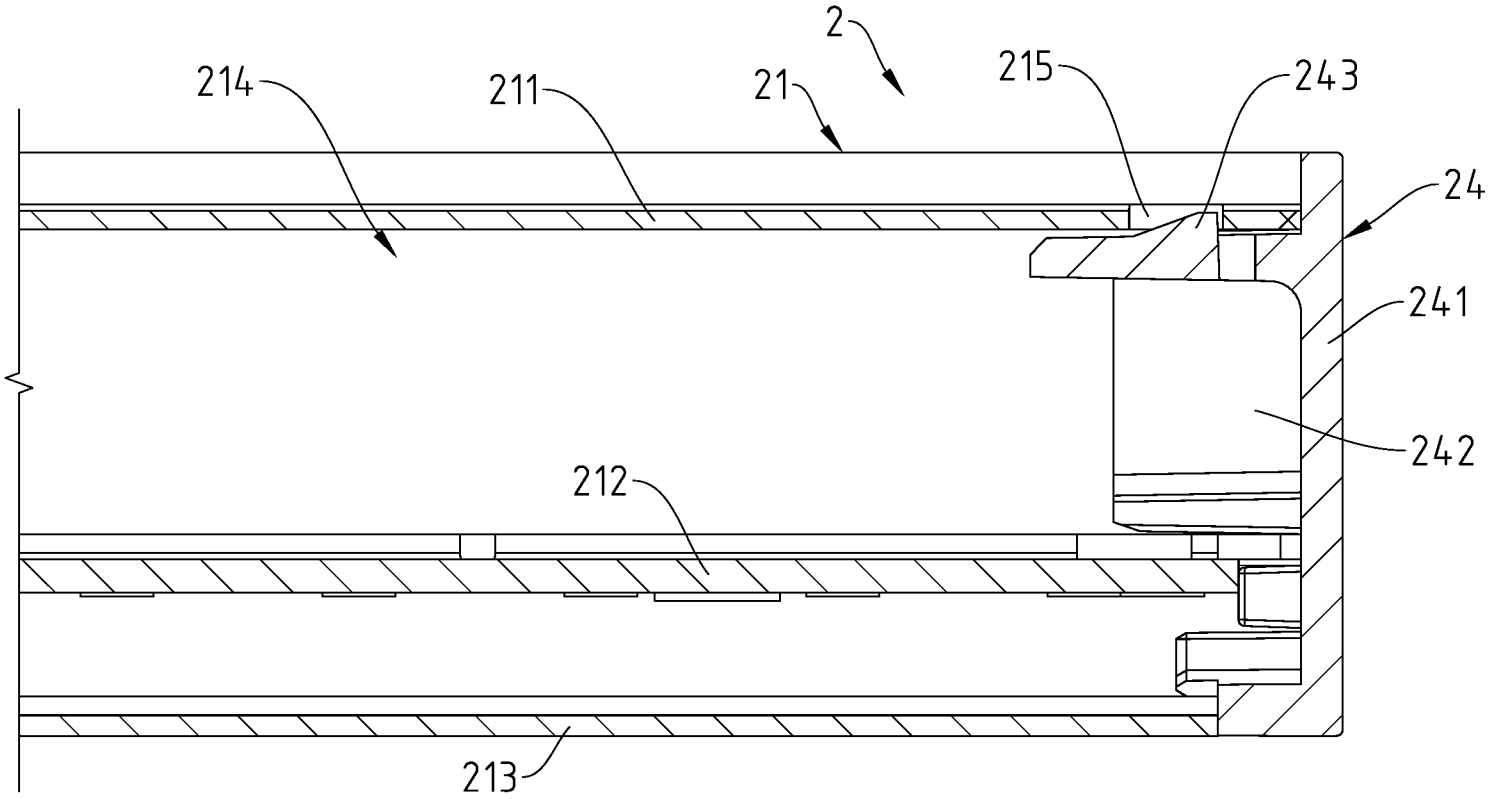
FIG. 7 is a sectional view of a part of the lighting fixture.

Referring to FIGS. 1-3, an interruption-free track light in accordance with the present invention is shown. The interruption-free track light comprises a track 1 and at least one lighting fixture 2 mounted to and movable along the track 1.

The track 1 comprises a hollow track shell 11, a plurality of power supply components 12 and a mating connection rail 13. The hollow track shell 11 defines therein a moving space 111. The power supply components 12 are longitudinally mounted in the hollow track shell 11. The mating connection rail 13 is longitudinally mounted at a bottoms side of the hollow track shell 11. The lighting fixture 2 comprises a light-emitting body 21, a plurality of clamps 22, an electrical connector 23 and two end caps 24. The two end caps 24 are made of a light guide material and respectively fastened to two opposite ends of the light-emitting body 21. The clamps 22 and the electrical connector 23 are mounted at a top side of the light-emitting body 21. Further, the electrical connector 23 is electrically connected to an internal circuit of the light-emitting body 21.

The track 1 further comprises a positioning frame 14 mounted in the hollow track shell 11 to surround the moving space 111. The power supply components 12 are installed in the positioning frame 14 and disposed at two opposite lateral sides of the moving space 111. When mounting the lighting fixture 2 in the track 1, insert the clamps 22 into the inside of the hollow track shell 11 of the track 1 to force the clamps 22 into engagement with an inner edge of the mating connection rail 13, causing the electrical connector 23 to be inserted into the moving space 111 of the hollow track shell 11 and electrically conducted with the power supply components 12. After installation, the light emitted by the light-emitting body 21 can go through the end caps 24 toward the outside of the lighting fixture 2.

Referring to FIGS. 2 and 3 again, the mating connection rail 13 comprises a first rail panel 131 and second rail panel 132 respectively and horizontally inwardly extended from two opposite bottom edges of the hollow track shell 11 toward a midpoint of the moving space 111. The positioning frame 14 is attached to an inner surface of the mating connection rail 13 to increase the thickness of the first rail panel 131 and the second rail panel 132, making the thickness of the first rail panel 131 to be greater than the thickness of the second rail panel 132. Each clamp 22 of the lighting fixture 2 comprises a first springy clamping arm 221, a second springy clamping arm 222, a first abutment portion 223 curved from a distal end of the first springy clamping arm 221, and a second abutment portion 224 extended from a middle part of the second springy clamping arm 222. When fastening the clamp 22 to the inside of the hollow track shell 11 of the track 1, insert the first springy clamping arm 221 into the hollow track shell 11 to force the first abutment portion 223 into abutment against an inner surface of the first rail panel 131 of the mating connection rail 13, then push the second springy clamping arm 222 toward the first springy clamping arm 221, enabling the second springy clamping arm 222 to be biased relative to the first abutment portion 223 into the inside of the hollow track shell 11. After released the applied force, the second abutment portion 224 is forced by the elastic restoring energy thereof into positive abutment against the inner surface of the second rail panel 132. Thus, the clamp 22 will not be excessively deformed during installation, avoiding breaking damage.

Referring to FIGS. 4-7, the light-emitting body 21 of the lighting fixture 2 comprises a housing 211, a light-emitting device 212 mounted in a bottom side of the housing 211, and a lampshade 213 fastened to the bottom side of the housing 211 and covered over the light-emitting device 212. The housing 211 comprises an accommodation open chamber 214 that extends longitudinally through two opposite ends of the housing 211, and two mounting through holes 215 respectively disposed near the two opposite ends thereof in communication with the housing 211 accommodation open chamber 214. Each end cap 24 comprises a light guide portion 241, two plug portions 242 bilaterally and perpendicularly extended from the light guide portion 241 in a substantially parallel manner, and a springy hook 243 spaced between the two plug portions 242. The plug portions 242 are inserted from one end of the housing 211 into the accommodation open chamber 214 to force the springy hook 243 into engagement with the respective mounting through hole 215, thereby holding the light guide portion 241 at one end of the light-emitting device 212 for the passing of the light emitted by the light-emitting device 212.

Figure 8:
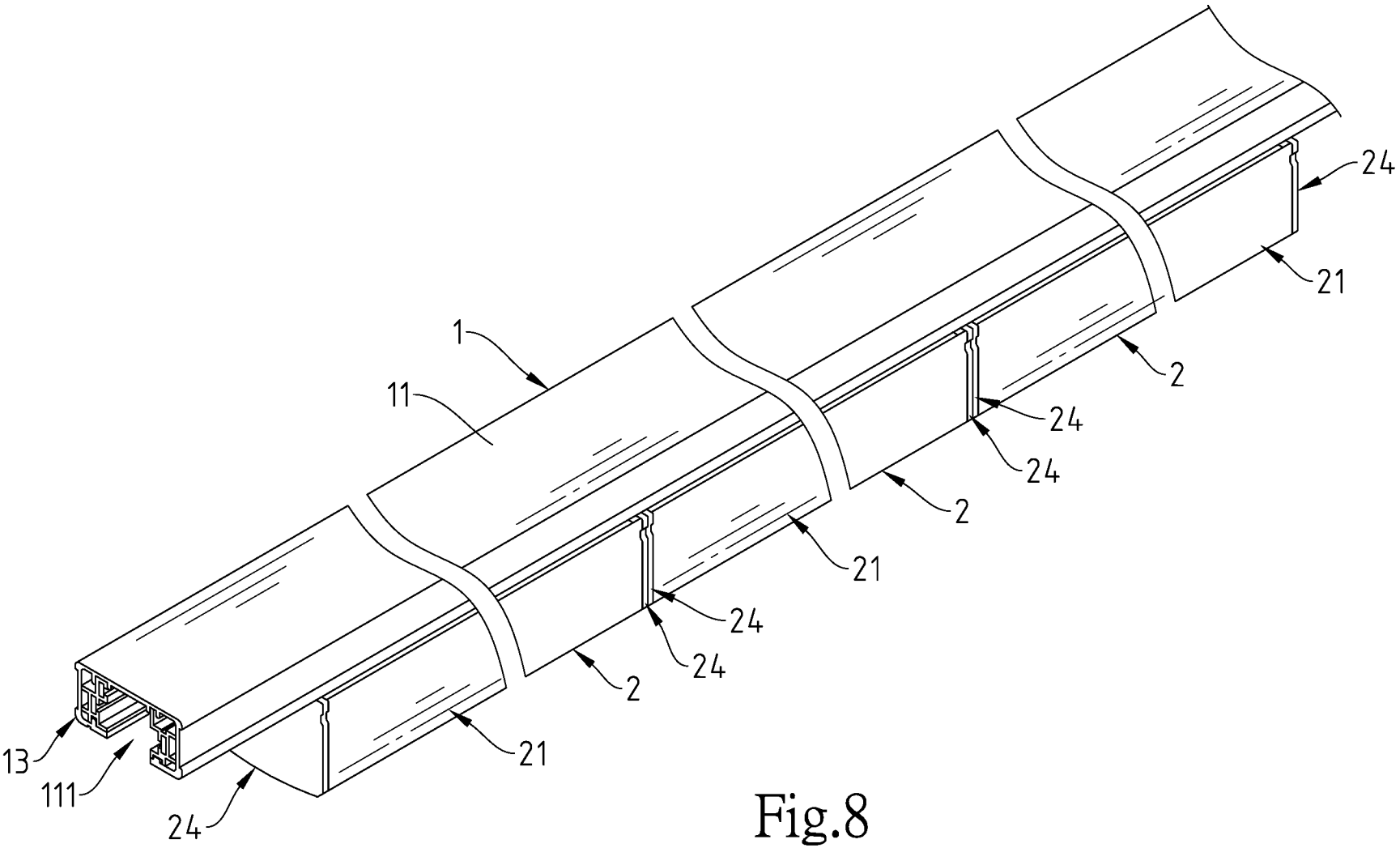
FIG. 8 is an elevational view, illustrating a plurality of lighting fixture mounted in the track and arranged in a line.
Figure 9:
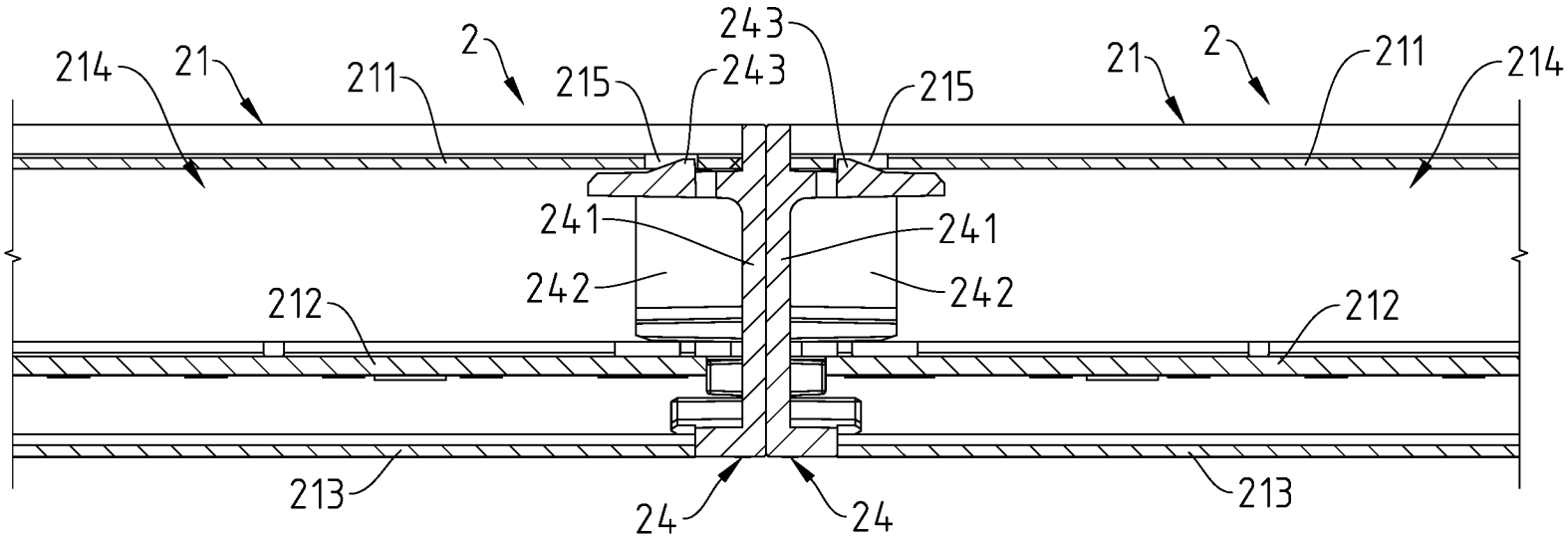
FIG. 9 is a sectional view, illustrating two lighting fixtures connected in a line.
Figure 10:
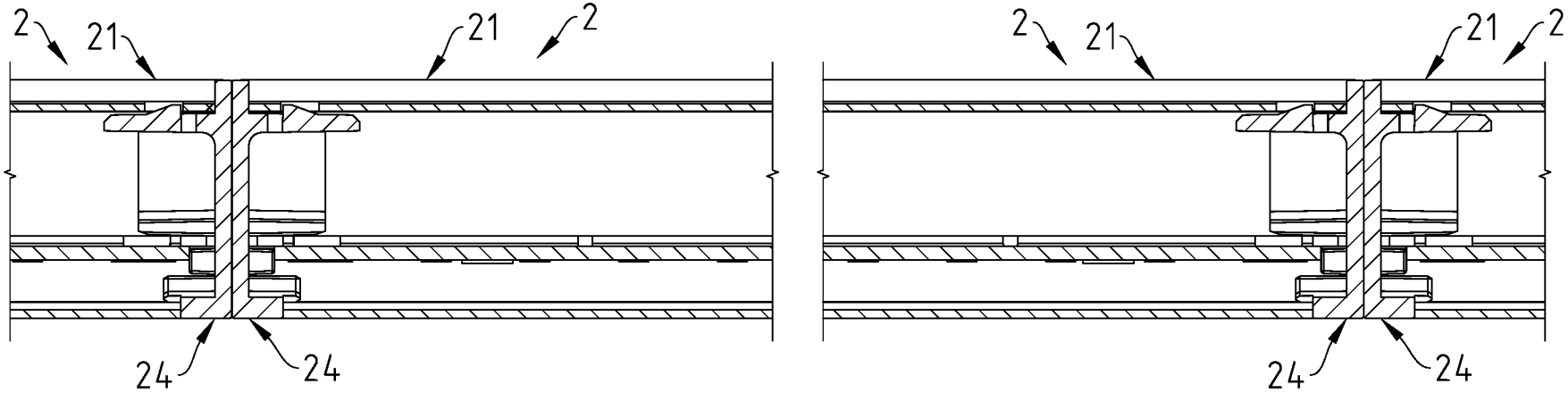
FIG. 10 is a schematic sectional view, illustrating a plurality of lighting fixtures connected in a line.

Referring to FIGS. 8-10, when multiple lighting fixtures 2 are mounted in the track 1 and arranged in a line, the light guide portion 241 of each end cap 24 distributes the emitted light over the respective end of the light-emitting body 21 to increase illumination brightness, avoiding generation of invalid dark area between the light-emitting bodies 21 of the lighting fixtures 2.

Therefore, the present invention solves the problems and deficiencies of the conventional designs. The key technique of the invention is to use the end caps 24 provided on both ends of each light-emitting body 21 so that when a plurality of light-emitting bodies 21 are arranged in a line on the track 1, no any invalid dark area will be produced between the light-emitting bodies 21. Further, the clamps 22 of the lighting fixture 2 can be directly fastened to the inside of the track 1 to directly force the electrical connector 23 into electrical conduction with the power supply components 12 in the track 1. Thus, the invention achieves the effects of interruption-free illumination, ease of installation and enhanced brightness.

What the invention claimed is:

1. An interruption-free track light, comprising:

a track comprising a hollow track shell, a plurality of power supply components and a mating connection rail, said hollow track shell defining therein a moving space, said power supply components being longitudinally arranged in said hollow track shell at two opposite lateral sides, said mating connection rail being longitudinally mounted at a bottom side of said hollow track shell; and at least one lighting fixture mounted in said track, each said lighting fixture comprising a light-emitting body, a plurality of clamps, an electrical connector and two end caps, said clamps and said electrical connector being provided at a top side of said light-emitting body, said electrical connector being electrically connected to an internal circuitry of said light-emitting body, said two end caps comprising a light guide configured to illuminate the dark regions at the ends of the lighting emitting body and respectively fastened to two opposite ends of said light-emitting body, said clamps being inserted into said hollow track shell of said track and abutted against an inner edge of said mating connection rail to hold said electrical connector in said moving space of said hollow track shell in conduction with said power supply components.

2. The interruption-free track light as claimed in claim 1, wherein said light-emitting body of each said lighting fixture comprises a housing and light-emitting device mounted in a bottom side of said housing, said housing defining therein an accommodation open chamber; each said end cap comprises a light guide portion and two plug portions bilaterally extended from said light guide portion and fastened to said accommodation open chamber of said housing to hold said light guide portion at one end of said light-emitting device for guiding the light emitted by said light-emitting device.

3. The interruption-free track light as claimed in claim 1, wherein said mating connection rail of said track comprises a first rail panel and a second rail panel respectively and horizontally inwardly extended from two opposite bottom edges of said hollow track shell toward a midpoint of said moving space; each said claim of each said lighting fixture comprises a first springy clamping arm and a second springy clamping arm, said first springy clamping arm and said second springy clamping arm being squeezed toward each other and then inserted in between said first rail panel and said second rail panel and then respectively clamped on an inner surface of said first rail panel and an inner surface of said second rail panel by the elastic restoring energy thereof.

4. The interruption-free track light as claimed in claim 3, wherein the thickness of said first rail panel of said mating connection rail is greater than the thickness of said second rail panel; each said clamp further comprises a first abutment portion curved from a distal end of said first springy clamping arm and a second abutment portion extended from a middle part of said second springy clamping arm, said first abutment portion and said second abutment portion being respectively abutted against an inner surface of said first rail panel and an inner surface of said second rail panel.

5. The interruption-free track light as claimed in claim 1, wherein said track further comprises a positioning frame mounted in said hollow track shell to surround said moving space; said power supply components are installed in said positioning frame and disposed at two opposite lateral sides of said moving space such that when said electrical connector of said lighting fixture is inserted into said moving space of said track, said electrical connector is electrically conducted with said power supply components.

* * * * *